US006505996B1

(12) United States Patent
Ianniello et al.

(10) Patent No.: US 6,505,996 B1
(45) Date of Patent: Jan. 14, 2003

(54) DRAINAGE SYSTEM WITH UNITARY VOID-MAINTAINING GEOSYNTHETIC STRUCTURE AND METHOD FOR CONSTRUCTING SYSTEM

(75) Inventors: Peter J. Ianniello, Havre De Grace, MD (US); Aigen Zhao, Clarksville, MD (US); Giovanni Capra, Ellicott City, MD (US)

(73) Assignee: Tenax Corporation, Baltimore, MD (US)

( * ) Notice: Subject to any disclaimer, the term of this patent is extended or adjusted under 35 U.S.C. 154(b) by 0 days.

(21) Appl. No.: 09/501,324

(22) Filed: Feb. 10, 2000

(51) Int. Cl.[7] ..... E01F 5/00; E02B 11/00

(52) U.S. Cl. ..... 405/36; 405/43; 405/46; 405/302.7; 404/2

(58) Field of Search ..... 405/36, 43, 45, 405/46, 50, 52, 270, 302.7; 404/2, 3, 4; 210/170, 747; 428/86; 442/383, 388, 57, 36

(56) References Cited

U.S. PATENT DOCUMENTS

| | | | | | |
|---|---|---|---|---|---|
| RE10,388 | E | * | 9/1883 | Henning | 241/46.02 |
| 1,969,267 | A | * | 8/1934 | Hubbard | 404/27 |
| 2,183,253 | A | * | 12/1939 | Chambers | 404/31 |
| 2,259,374 | A | * | 10/1941 | Gramelspacher | 404/28 |
| 3,654,765 | A | * | 4/1972 | Healy et al. | 405/45 |
| 3,690,227 | A | * | 9/1972 | Welty | 404/2 |
| 3,765,783 | A | * | 10/1973 | Wagner | 404/2 |
| 4,309,855 | A | | 1/1982 | Pate et al. | |
| 4,311,273 | A | * | 1/1982 | Marsh | 405/131 X |
| 4,572,700 | A | * | 2/1986 | Mantarro et al. | 405/35 |
| 4,768,897 | A | * | 9/1988 | Nussbaumer et al. | 405/50 X |
| 4,898,494 | A | * | 2/1990 | Ellis | 404/2 |
| 4,925,342 | A | * | 5/1990 | Hendy | 405/45 |
| 4,943,185 | A | * | 7/1990 | McGuckin et al. | 405/45 |
| 5,183,355 | A | * | 2/1993 | Treat et al. | 405/52 X |

(List continued on next page.)

FOREIGN PATENT DOCUMENTS

| | | | |
|---|---|---|---|
| WO | WO-9511350 | * | 4/1995 |

*Primary Examiner*—Jong-Suk (James) Lee
(74) *Attorney, Agent, or Firm*—Gary L. Shaffer

(57) ABSTRACT

Unitary void-maintaining geocomposites, and drainage systems utilizing those geocomposites, are provided for location below a road surface or below a large structure such as a building, retaining wall or parking lot. In some embodiments, the geocomposites include at least one fluid-transmissible layer, preferably a geotextile, attached adjacent an upper or lower surface, or both surfaces, of a polymer-based core element. In other embodiments, the core element is constructed such that no geotextile layer is needed. Characteristic of the core element is high transmissivity, that is, a high rate of horizontal flow of gases or liquids through the core. Characteristic of the at least one fluid-transmissible layer is high permittivity, that is, a high rate of vertical transmission of liquids and gases through the geotextile layer and into the core element. Also characteristic of fluid-transmissible layers of the invention is high exclusivity with respect to solid materials. Core elements and fluid-transmissible layers can be formed simultaneously as a unit, or the several components may be bonded to one another by welding or adhesives. The systems include further drain means that communicate with the geocomposite structures of the system, such as perforated pipes and the like, which can connect further to culverts, ditches or waterways. The geocomposite structures and drain means may be placed below the subgrade, over the subgrade, or at the top and bottom of the base underlying a roadway or large structure. Unitary void-maintaining geocomposites can form part of a greater subsurface geosynthetic system that provides reinforcement, separation, and drainage for the structure to thereby extend its useful life and decrease maintenance costs.

18 Claims, 10 Drawing Sheets

U.S. PATENT DOCUMENTS 5,255,998 A * 10/1993 Beretta ..... 405/36
5,360,294 A * 11/1994 Carriker et al. ..... 405/270
5,507,900 A * 4/1996 Mohammed et al. ..... 428/57 X
5,662,983 A 9/1997 Stark
5,713,696 A 2/1998 Horvath et al.
5,747,134 A 5/1998 Mohammed et al.
5,836,115 A 11/1998 Clay et al.
5,877,096 A * 3/1999 Stevenson et al. ..... 442/36
5,882,453 A 3/1999 Stark
5,891,549 A * 4/1999 Beretta et al. ..... 428/100
5,954,451 A * 9/1999 Presby ..... 405/36 X
5,980,155 A * 11/1999 Jones et al. ..... 405/43
6,095,720 A 1/2000 Stark
6,095,718 A * 8/2000 Bohnhoff ..... 405/52
6,152,653 A * 11/2000 Henry et al. ..... 405/129.7

* cited by examiner

DRAINAGE SYSTEM WITH UNITARY VOID-MAINTAINING GEOSYNTHETIC STRUCTURE AND METHOD FOR CONSTRUCTING SYSTEM

FIELD OF THE INVENTION

The present invention relates generally to void-maintaining geosynthetic systems for the drainage of water and other fluids, and more particularly to geosynthetic structures having a void-maintaining core that may be sandwiched between attached or uni-formed geotextile layers. Geosynthetic structures of the invention are ideal for providing subsurface drainage for roadways and other large structures such as parking lots, retaining walls and buildings.

BACKGROUND OF THE INVENTION

The building of large structures such as roadways, buildings, parking lots, retaining walls, embankments and the like often involves the excavation, re-contouring and other movement of large quantities of earthen materials such as soil, rock, earth, gravel, sand and the like. Most large structures have underlying foundations of some sort to support the weight of the structure and thereby stabilize the structure in its desired position with respect to the earth and with respect to other parts of the same structure. For example, roadways and parking lots usually have foundations comprising a base aggregate immediately under the paved surface, and a subgrade layer under the base aggregate which supports the weight of both of the overlying structures. Commonly, both the base and subgrade are formed of stones, soil and other earthen materials and subjected repeatedly to grading, tamping or other compaction operations and thereby formed into a foundation of desired density, elevation, inclination and direction. Buildings commonly have concrete foundations or concrete slabs that support the weight of the overlying structure.

The presence of water or other fluids near, within or under such foundations can be quite disadvantageous. For example, water or other fluids in the foundation materials underlying such structures can cause hydraulic pore pressure buildup and reduction in the effective stress in the soil materials. These conditions can directly or indirectly contribute to failure of the underlying materials that support the overlying foundation and can thereby also cause a failure of the overlying structure. It is thus important to positively control the water or other fluids and dissipate pore pressure underlying large structures and in the vicinity of and underlying the foundations of such large structures.

The movement of soil particles around and underlying structures is not limited to that caused by the presence of fluids. Movement can occur from repeated or repetitive dynamic loads, as well as static loads that cause destabilizing stresses within the soil structure. One way of controlling such movement is to provide reinforcing products such as frameworks which are integral to the materials underlying the foundation, or within it, to thereby prevent or impede such undesired movement. Geosynthetics are materials often used to provide such a framework. The use of geosynthetics contributes to controlling movement of soil particles and structural fill materials in four primary ways:

1) By creating higher degrees of friction between the natural materials and the surface of the geosynthetic when compared to the frictional characteristics of the soil itself in order to minimize soil movement in horizontal, vertical and diagonal directions.

2) By confining soil fill material within the geosynthetic structure in an attempt to control lateral movement of soil particles.
3) By providing a nonporous, impermeable membrane type barrier that minimizes vertical migration of soil particles and fluids. At times, horizontal and diagonal movement of soil particles is impeded by roughening or texturing the geosynthetic in order to increase the friction between the soil and the geosynthetic.
4) By providing a semiporous, porous, or permeable barrier that minimizes vertical migration of soil particles by not allowing soil particles to move through openings in the geosynthetic that are effectively smaller than the diameter of the soil particles themselves, while also allowing fluids to migrate vertically, diagonally and horizontally irrespective of gravity through one or more layers of a single or multi-ply geosynthetic.

These porous, semiporporous or permeable geosynthetics allow fluids to pass vertically and horizontally through their structures. Capillary connections sometimes occur and are one aspect that allow fluids to migrate vertically and diagonally irrespective of gravity through multi-ply geosynthetics. Capillary connections are created by the contacting of two or more plys of geosynthetics and provide continuous vertical or diagonal capillary paths through which fluids may travel. Typically, capillary connections may appear in a semi-continuous pattern across the horizontal plane of a geosynthetic comprising more than one ply. These connections, which are formed when the polymer strands of one ply of a geosynthetic contact the polymer strands of another ply often occur when layers of geosynthetics are arranged or constructed to allow one ply to be placed directly on top of another ply. Polymer strands of individual geosynthetic plys assist fluid migration in the horizontal plane of the specific geosynthetic ply. This horizontal transmission of fluid can be expressed as a rate of flow per unit width within the plane of a geosynthetic and is typically called "transmissivity." On the other hand, the vertical transmission rate of fluid, or "permittivity" of a geosynthetic is typically expressed by measuring the rate of flow per unit area per unit thickness. Permitivity is a quantifiable property that can be controlled during the maufacturering process.

Vertical and diagonal capillary connections can be created even when two or more plys of geosynthetic are arranged in substantially but parallel planes when polymer strands of one ply become in contact with the polymer strands of another ply. This can occur under the normal pressures that are placed upon the geosynthetic from the overlying soil burden which forces polymeric strands of the separate plys together thereby allowing fluids to migrate against gravity at the sites of the continuous capillary connections. The flow of fluids through a geosynthetic against gravity is often referred to as "wicking," and is distinguished from permitivity. Wicking occurs after field installation of the product and is not a predictably quantifiable characteristic of the system but is dependent on a number of different factors. Wicking, the fluid transmission against gravity resulting from capillary connections created by the deformation and intercontact of geosynethic plys, is a property that is sometimes advantageous and other times disadvantageous.For example, in applications where the user desires water to be transmitted against gravity these, capillary connections may provide a benefit. In contrast, using geosynthetics in applications where the user does not want fluid to pass via the mechanism provided by the capillary connection can be a detriment to the particular structure.

In general, geosynthetics are manufactured as substantially planar, or sheetlike, products from polymeric materials. Geosynthetics are usually made in large scale, for example, several meters in width and many meters in length so that they are easily adaptable to large scale construction and landscaping uses. Some geosynthetics are flexible or fabric-like and therefore conform easily to uneven or rolling surfaces. Some geosynthetics are manufactured to be less flexible but to possess great tensile strength and resistance to stretching or great resistance to compression. Certain types of geosynthetic materials are used to reinforce large man-made structures, particularly those made of earthen materials such as gravel, sand and soil. In such uses, one purpose of using the geosynthetic is that of holding the earthen components together by providing a latticework or meshwork whose elements have a high resistence to stretching. By positioning the geosynthetic integral to the gravel, sand and soil, that is, with the gravel, sand and soil within the interstices of the geosynthetic, unwanted movement of the earthen components is minimized or eliminated. Most geosynthetic materials, whether of the latticework type or of the fabric type, allow water to pass through them to some extent and into the material within which the geosynthetic is integrally positioned. Thus, geosynthetic materials and related geotechnical engineering materials are used as integral parts of man-made structures or systems in order to stabilize their salient dimensions.

A particular problem faced by the FHWA, the DOT and many highway and transportation agencies across the United States and elsewhere is the high-cost and difficult maintenance of state and interstate roadways. A significant cause of this high cost and these difficulties is the entrapment and retention of water and other fluids which damage roadways and greatly reduce their useful life. This is the case even on those projects where conventional geosynthetics are used. Water in pavement systems that are inclusive or exclusive of geosynthetic is one of the principal causes of pavement distress. Fluid such as water enters the subsurface either from the subgrade soil, that is, the native ground upon which the roadway is constructed, or from rainwater or floodwater penetrating open spaces such as cracks and pits within the road surface. Under common usage, vehicular traffic across the roadway produces a dynamic or repetitious loading force on the road that creates a "pumping action" that draws fluid through the subgrade into the subbase or base coarse of the road. When this fluid is retained within the subbase or road base, damage to the roadway occurs. As indicated in the AASHTO design methodology (1993), drainage performance can range from excellent (water is removed from the roadway systems within two hours) to poor drainage (water is removed within one month). The corresponding drainage coefficient (direct design parameter) for an excellent drainage is 3.0 times greater then the corresponding drainage coefficient for poor drainage. The higher drainage coefficient increases the structural number. Therefore, the service life of the structures can be extended or the overall structural cross-section can be reduced. When there is a high fluid content within the soil supporting the traffic lanes, reduced bearing capacity can occur, resulting in deformation of the contour of the road, wheel rutting, and premature collapse or failure of the roadway.

Another drainage issue particular to construction of roadways and other large structures in regions with cold climates relates to frost damage to pavements due to frost heaving and subsequent thawing. Frost heaving, the raising of the pavement surface occurs due to the formation of ice lenses, which can grow up to several centimeters in the thickness, in the underlying soil. Differential frost heaving leads to adverse pavement roughness and hazardous driving conditions. Thawing or frozen pavements in frost-melting periods causes a supersaturated soil condition. If the drainage provisions are inadequate, the bearing capacity of the pavement is substantially reduced, which in turn causes bearing capacity failure or surface cracking. Traffic loading during the thaw season can also pump fine-grained subgrade soils into the subbase or base course. Among the economic losses by frost damage are costs of repair and maintenance, possible restrictions of vehicle weight-limits or even complete closure of the traffic. All of these conditions can be extremely costly. To reduce damage caused by frost heaving, in 1963 the U.S. Army Corps of Engineers suggested two strategies: 1)the control of surface deformation resulting from frost action by limiting the amount of frost-susceptible soil subjected to freezing temperatures; and 2) employing designs of adequately large bearing capacities sufficient to withstand stresses experienced during the most critical climatic period. This means a significant increase in aggregate thickness and the concomitant increase in cost and time required to construct a given structure.

Design methods based on the above two concepts call for the use of clean, nonfrost-susceptible base material. Such material is becoming more and more expensive to obtain and transport. Due to the required serviceability that an engineer must account for in the design for their clients, these types of expensive soils are often forced to be considered in civil engineering projects, thus making demand for them higher and, consequently, an increase in their prices.

Frost damage can be reduced by introducing a capillary break, or water barrier, to reduce water migration into the freezing front. Various methods are known to deal with this problem. For example, Finland and Sweden have used a layer or sand to break the capillary connection between frost-susceptible soils (Rengmark, 1963; Taivenen, 1963). This insulating layer of sand was found to help reduce and smooth frost heave, and also to increase the bearing capacity during the spring thaw.

Before the present invention, previous drainage systems using geosynthetic structures are exclusively limited to providing drainage at the edge or shoulder of a roadway. These edge-drain systems are commonly located within a covered trench originally dug along the shoulder of the roadway, in an area which receives little or no dynamic load from the roadway. Usually serving a dual purpose, the edge-drain relies upon natural drainage from directly beneath the road surface within the subbase or subgrade to carry fluid to the edge-drains for collection and further distribution, for example, by way of a shoulder pipe. The material of the subbase or subgrade acts also as a filter to prevent adjacent soil from clogging the drainage system. The drainage system directly beneath the surface of a roadway is often made of unstabilized granular, asphalt stabilized granular, or cement stabilized aggregate material. Such "natural material" drainage systems, if installed properly, can be used to carry large amounts of fluid from the subbase to the edge-drain.

There are many disadvantages to natural material drainage systems, however. Such systems require the subsurface aggregate to possess a uniform size gradation to provide void spaces, that is, interconnecting holes within the drainable base to carry fluid. Disadvantageously, the requirement for interconnecting void spaces to afford good drainage conflicts with road pavement systems designed for long-term use. This is so because roadways designed for long-term use require minimal void spaces in order to reduce the movement of particles, sand and aggregate. Free-draining aggregate usually require an asphaltic or cement stabilize binder to facilitate construction. Additionally, a well-graded granular or geotextile filter layer is needed to prevent contamination of the open graded base through the migration of subgrade fines. This extra filter layer further increases the cost of the roadway construction. Furthermore, high construction costs are incurred for a complete drainage layer of natural stone or sand that must be installed with precision, and extensive on-site quality control must be exercised, in order to produce a high-flow draining system which lasts for the life of the overlying paved surface.

When positioned directly beneath the road surface, conventional geosynthetic structures are primarily used to provide reinforcement of the base, subgrade stabilization, subgrade restraint, separation of the base course from the subgrade, or as a thermal break to provide insulation from temperature changes. Until the present invention, however, geosynthetic materials had not been designed or implemented to provide a positive drainage system effective enough to provide adequate drainage for an entire roadway or for an entire roadway portion. Similarly, until the present invention, no geosynthetic material had ever been designed to break the capillary connection that can occur as a result of the repeated dynamic traffic loads that can cause a capillary connection between different plys of geosynthetics, nor has a geosynthetic ever been used to provide a void maintaining system for the entire design life of a roadway and thereby serve as an effective capillary break to prevent moisture migration into the base course layer or into the frost susceptible soil layer, or underneath an entire roadway.

There is therefore a need for a drainage system that can be positioned within a large structure and provide efficient and cost-effective drainage for the structure while also providing a capillary break by utilizing components which can be engineered and manufactured offsite.

SUMMARY OF THE INVENTION

The present invention overcomes the previously mentioned disadvantages by providing a drainage system which provides interconnected drainage voids and also functions as a capillary break under substantial portions of the ground underlying roadways, parking lots, retaining walls, buildings and other large structures. Structures of the present invention are unitary void-maintaining geocomposite structures (to be sold under the trademark "UVMG") UVMG's according to the invention can be constructed and positioned within one or more of the subsurface levels at predetermined locations under a large structure such as a roadway or building. The present UVMG's typically comprise a void-maintaining core such as a geonet adjacent to one or more layers of fluid-transmissable geotextile fabric. The structures are unitary in that the core element is preferably manufactured simultaneously with its filtration medium to form a unitary geocomposite. Another method of manufacture is for the core element and geotextile elements to be formed separately and then adhered to one another by heat, laser or electron beam welding, or by means of adhesives applied to one or more of the components to thereby form a unitary structure in advance of installation of the UVMG at a desired site.

The permittivity of a material relates to its ability to permit gases, water and other fluids to pass vertically, or substantially vertically, through the material. The fluid-transmissible layers of the present invention provide high permittivity of subsurface fluids such as water into the core element. Geotextiles are preferred as the fluid-transmissible layers of the invention. Other materials possessing high permittivity and high occlusiveness to solids are also suitable for the present invention. Structures of the present invention also possess high transmissivity. The transmissivity of a material relates to its ability to transmit gases, water or other fluids horizontally, or substantially horizontally, in a particular or desired direction. Typically, permittivity is measured as the rate of flow per unit area per unit width while transmissivity is measured in terms of rate of flow per unit width. Core elements of the present invention possess high transmissivity because of their interconnecting openings, which permit fluids to flow substantially horizontally away from the overlying or underlying structure. Thus, UVMG's eliminate many of the problems presented by the presence or movement of fluids such as water in the areas underlying large structures. By eliminating these problems, the useful life of the subject structure is extended.

The present invention relates generally to unitary void-maintaining geocomposite structures and systems for water drainage, and more particularly to such geocomposite structures combined with additional drainage elements such as pipes, conduits, edge drains, culverts and ditches for the subsurface drainage of roadways and other large structures such as parking lots, retaining walls and buildings.

A principal object of the present UVMG invention is to provide a subsurface drainage system that, among other things, provides a capillary break to thereby prevent unwanted movement of the structure, such as frost heaving, to thereby extend the useful life of a roadway or other large structure.

It is another object of the present invention to provide cost-effective alternatives to previous large-structure subsurface drainage systems.

An additional object of the invention is to provide unitary geocomposite materials which include both void-maintaining elements and geotextile or other filtration elements having high permitivity for fluids while preventing solid particles that are larger than openings in the filtration element from entering the void-maintaining system.

It is a further object of the present invention to transfer certain quality control aspects of road construction and reconstruction from the construction site to a manufacturing facility for roadway drainage products.

It is yet another object of the present invention to provide subsurface drainage unitary void-maintaining geocomposites as part of a greater road subsurface geosysthentic system to thereby enable efficient reinforcement, separation, filtration, gas transmission and egress, and drainage for a large structure such as a roadway, retaining wall, parking lot or building.

In accordance with this and other objects, the present invention provides a drainage system for draining fluids away from a roadway or other large structure, comprising a unitary void-maintaining geocomposite, the geocomposite comprising a geocomposite core element having a plurality of interconnected voids, the core element having an upper surface and a lower surface, and at least one fluid-transmissible layer of high permittivity adjacent the upper surface, wherein the layers are constructed and arranged so that the geocomposite maintains voids of sufficient dimension that the water from the roadway or other large structure can move freely through the geocomposite, and wherein the geocomposite is sloped downwardly from the roadway or other large structure.

The unitary void maintaining geocomposite may further comprise at least one fluid-transmissible layer, for example, a geotextile, adjacent the lower surface of the void-maintaining geocomposite, and may also further comprise drain means adjacent the void-maintaining geocomposite and communicating therewith such that the fluid can move from the void-maintaining geocomposite to the drain means, wherein the drain means is sloped preferably downwardly from the void-maintaining geocomposite. In accordance with advantageous drainage aspects of the invention the void-maintaining geocomposite is sloped downwardly away from a portion of the roadway or the large structure such that the fluid is directed away from the roadway or the large structure and the void-maintaining geocomposite communicates with the drain means under the roadway or at a margin of the roadway or the large structure.

In accordance with additional objects of the invention, the drain means may further comprise a ditch or culvert adjacent a margin of the roadway or the large structure, and the drainage means may comprise perforated piping such as is commonly found in civil engineering applications.

In some preferred embodiments of the present invention, the void-maintaining geocomposite wraps around the circumference of the perforated piping and the perforated piping is connected to further drains means wherein the further drain means is one or more selected from the group consisting of non-perforated pipes, drainage ditches, sumps, canals, streams and rivers. Preferably one or both of the geotextile layers are attached to the geocomposite core element by heat or fusion welding, by laser welding, or by adhesives known in the geotextile arts. Of course, as one of skill in the art can appreciate, in certain applications, it may be most efficacious to position the geotextile layers adjacent the geocomposite core element without attaching them to one another. This may be preferable in situations where separate portions of geocomposite core element are overlapped or butt joined to one another and where it is desirable that no similar joint exists in the corresponding geotextile layer.

In other preferred embodiments of the invention the geocomposite core element comprises a geonet such as that found in U.S. Pat. No. 5,891,549 to Beretta et al. In other preferred embodiments, the geocomposite core element is tri-planar such as shown in U.S. Pat. No. 5,255,998 and comprises polyethlene, polypropylene or other polymer derivatives, and both fluid-transmissible layers are geotextiles that are nonwoven and needle punched. U.S. Pat. Nos. 5,891,549 and 5,255,998 are incorporated herein by reference.

In accordance with additional advantageous aspects of the invention, the void-maintaining geocomposite structure is constructed and arranged to form a wrapping adjacent to and around the circumference of the perforated piping such that a portion of one of the upper or lower fluid-transmissible geotextile layers is removed along the length of the wrapping so that the geocomposite core contacts the piping and the removed portion of the one of the upper or lower fluid-transmissible geotextile layers is overlapping and connected to the other surface fluid-transmissible geotextile layer. As one of skill in the art will recognize, it is advantageous to provide piping or other drain means which has a capacity to carry away a sufficient volume of fluid collected through the relatively large surface area of the present geocomposite core element.

Moreover, by interconnecting the various portions of the present invention such that the various interconnecting voids maintain flow paths for fluid such as water entering the system, large areas under highways, buildings, parking lots, and other large structures can be effectively drained without the necessity of complex and expensive structures. In order to maintain the interconnections preferred in the present invention, the overlapping portions of the fluid-transmissible geotextile layers are connected by ties, welding or by sewing, and the portions of the fluid-transmissible geotextile layers and the geocomposite core element of the void-maintaining geocomposite are held adjacent to the piping by circumferential ties around the geocomposite. Of course, as one of skill will recognize, the present invention is particularly advantageous for draining water-containing fluids or other geologic fluids such as petroleum or natural gas from roadways and other large structures.

In accordance with other aspects of the present invention, a drainage system disposed at a level below the top surface of a roadway for draining fluids such as water away from the roadway is provided, wherein the system comprises a unitary void-maintaining geocomposite comprising a geocomposite core element having a plurality of interconnected voids, the core element having an upper surface and a lower surface, and at least one fluid-transmissible geotextile layer of high permittivity attached adjacent the upper surface, wherein the layers are constructed and arranged so that the unitary void-maintaining geocomposite structure maintains voids of sufficient dimension that the water from the roadway can move freely through the geocomposite, and wherein the geocomposite is sloped downwardly from the top surface of the roadway.

Unitary void maintaining composites further comprise at least one fluid-transmissible layer, preferably a geotextile, attached adjacent the lower surface of the core element and, preferably, drain means adjacent the geocomposites and communicating therewith such that the fluid can move from the geocomposites to the drain means, wherein the drain means is sloped downwardly from the geocomposites such that the fluid is directed away from the roadway, wherein the geocomposite is constructed and arranged to provide a capillary break between the roadway pavement system and the earthen materials under the geocomposite.

In accordance with still other aspects of the present invention, the unitary void-maintaining geocomposites of the present invention can be positioned in a roadway to maximize their effectiveness. For example, in order to provide positive drainage functions, as needed, the geocomposite can be positioned intermittently or continuously below the top Portland Cement Concrete ("PCC") or asphalt layer of the roadway. To provide a capillary break in frost-prone regions, the geocomposite can be placed between the underground water table and frost-penetration depth, or freezing front. The present geocomposites can also be used to provide a capillary break function in non-frost-prone regions where the base layer contains fine grained soil with the potential for vented moisture migration through capillary rising. In order to maximize other advantages of the present invention, the void-maintaining geocomposites may be positioned in multiple layers, and at various levels below the roadway surface in order to maximize drainage efficiency as desired.

The void-maintaining geocomposites of the present invention can be made in large pieces, for example, in pieces several meters wide and many meters long. For convenience and installation, however, the geocomposites of the present invention, or their components can be installed in portions which are interconnected such that the interconnecting voids are of sufficient dimension that the water from the roadway can move freely through the geocomposite and can be connected to drain means such as a ditch or culvert adjacent a margin of the roadway or the large structure or perforated piping.

Moreover, the void-maintaining geocomposites of the present invention can be constructed and arranged to prevent wicking upward, to provide continuous or discontinuous capillary breaks across the area of the geocomposite, or to prevent wicking substantially altogether by the provision of void spaces.

Other advantages of the present invention are found in the methods which it provides. The present invention includes methods for providing drainage systems for roadways or other large structures. For example, the present invention provides a method for constructing a drainage system for draining fluids away from a roadway or other large structure, the method comprising providing a void-maintaining geocomposite including at least one geocomposite core element having a plurality of interconnected voids, the core element having an upper surface and a lower surface, and at least one fluid-transmissible geotextile layer adjacent the upper surface, wherein the components are constructed and arranged so that the geocomposite maintains voids of sufficient dimension that the water from the roadway or other large structure can move freely through the geocomposite, and wherein the geocomposite is sloped downwardly from the roadway or other large structure.

Preferably, the void-maintaining geocomposite further comprises at least one fluid-transmissible geotextile layer of high transmissivity adjacent the lower surface of the geocomposite and drain means adjacent the geocomposite and communicating therewith such that the fluid can move from the geocomposite to the drain means, wherein the drain means is sloped downwardly from geocomposite.

The high transmissivity layers and core elements of the void-maintaining geocomposites of the invention can be positioned at junctions between pieces such that high transmissivity between the void spaces maintained within the geocomposite and those of the drain means is maintained. With respect to the joining of large pieces of the geocomposites, this can be accomplished, for example, by providing geotextile layers which extend beyond the margins of the core composite layer, or by positioning additional pieces of geotextile over the joint areas. With respect to the junctions between the drain means and the geocomposites, portions of the geotextiles can be positioned around the drain means to thereby decrease the likelihood of the intrusion of clogging materials and to maintain the connection between voids of the geocomposites and those of the drain means.

The means and methods of the present invention include the positioning of the geocomposites and drain means in many permutations depending on the particular needs of the structure to be drained. For example, geocomposites of the invention can be positioned below the roadway or large structure and above an aggregate layer if desired. Moreover, the present methods include combinations wherein the geocomposite is positioned below the roadway or large structure in portions which are interconnected such that the interconnecting voids are of sufficient dimension that the water from the roadway can move freely through the connecting portions and thereby through the geocomposite. The present methods include wherein the drain means further comprises a ditch or culvert adjacent a margin of the roadway or the large structure.

As a further advantage, the combinations and methods of the invention comprise wherein the roadway base course comprises materials which have been excavated from the subgrade of the roadway and wherein the roadway base course comprises materials which have been excavated from the subgrade of the roadway and mixed with imported materials.

DETAILED DESCRIPTION OF THE INVENTION

Figure 1:
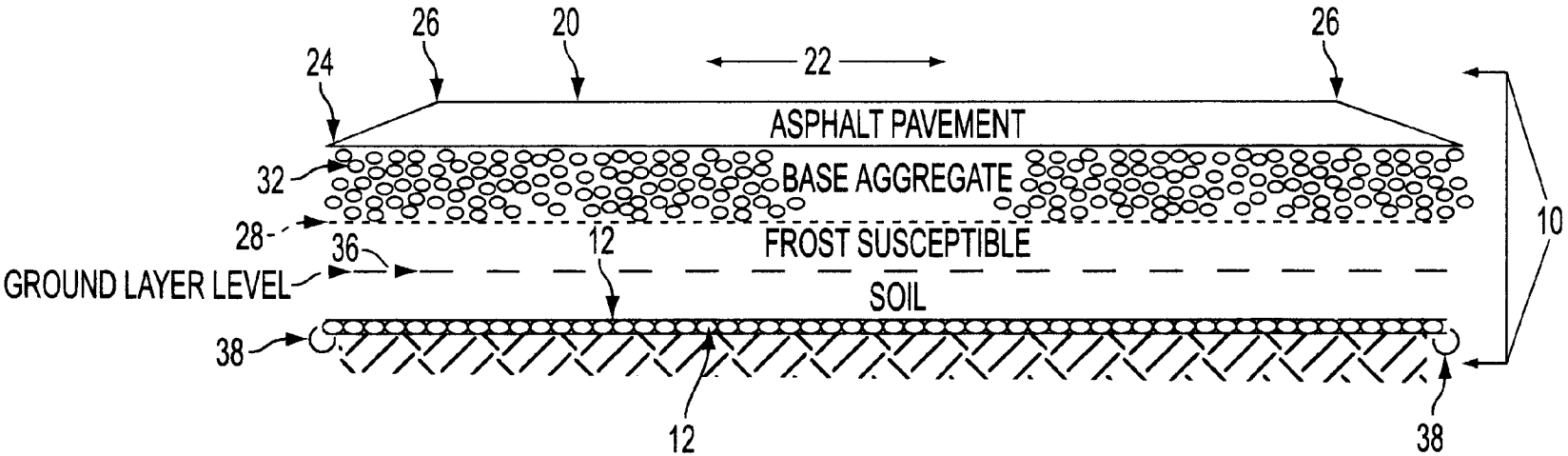
FIG. 1 is a cross-sectional view of a preferred embodiment of the unitary void-maintaining geocomposite of the present invention in operative combination with a roadway forming a capillary break below frost susceptible soil.

With reference to FIG. 1, one preferred embodiment of the drainage system 10 according to the present invention is depicted. In common usage, vehicular traffic 22 occurs across roadway 20. The roadway structure generally includes asphalt layer 24, base 28, and subgrade 36. Commonly, the base is comprised of aggregate, and the aggregate may comprise a variety of materials including crushed stone, rock, gravel, lime, millings and other materials. As one of skill in the highway and civil engineering arts will appreciate, although the above-described roadway is a common roadway structure, there are many other examples typical of roadway structures. Roadways commonly may include other combinations of the asphalt or concrete surface layer, base, subbase, and/or aggregate additives such as crumbs, granules, crushed concrete and masonry, and fly ash as are available or needed for a particular roadway structure application. In the preferred embodiment shown in FIG. 1, the drainage system 10 lies below subgrade 36. Subsurface drainage occurs as fluids, such as water or trapped gases from the natural ground are directed downwardly through subgrade 36 to void-maintaining geocomposite 12 to drainage collection pipe 38, which is preferably porous or perforated, and located beneath road shoulders 26 on either side of roadway 20.

Subsurface drainage occurs also as fluids, such as water from the natural ground water are directed upwardly through subgrade 36 through upward capillary action into void-maintaining geocomposite 12 to drainage collection pipe 38, which is preferably porous or perforated, and located beneath road shoulders 26 on either side of roadway 20.

Figure 2:
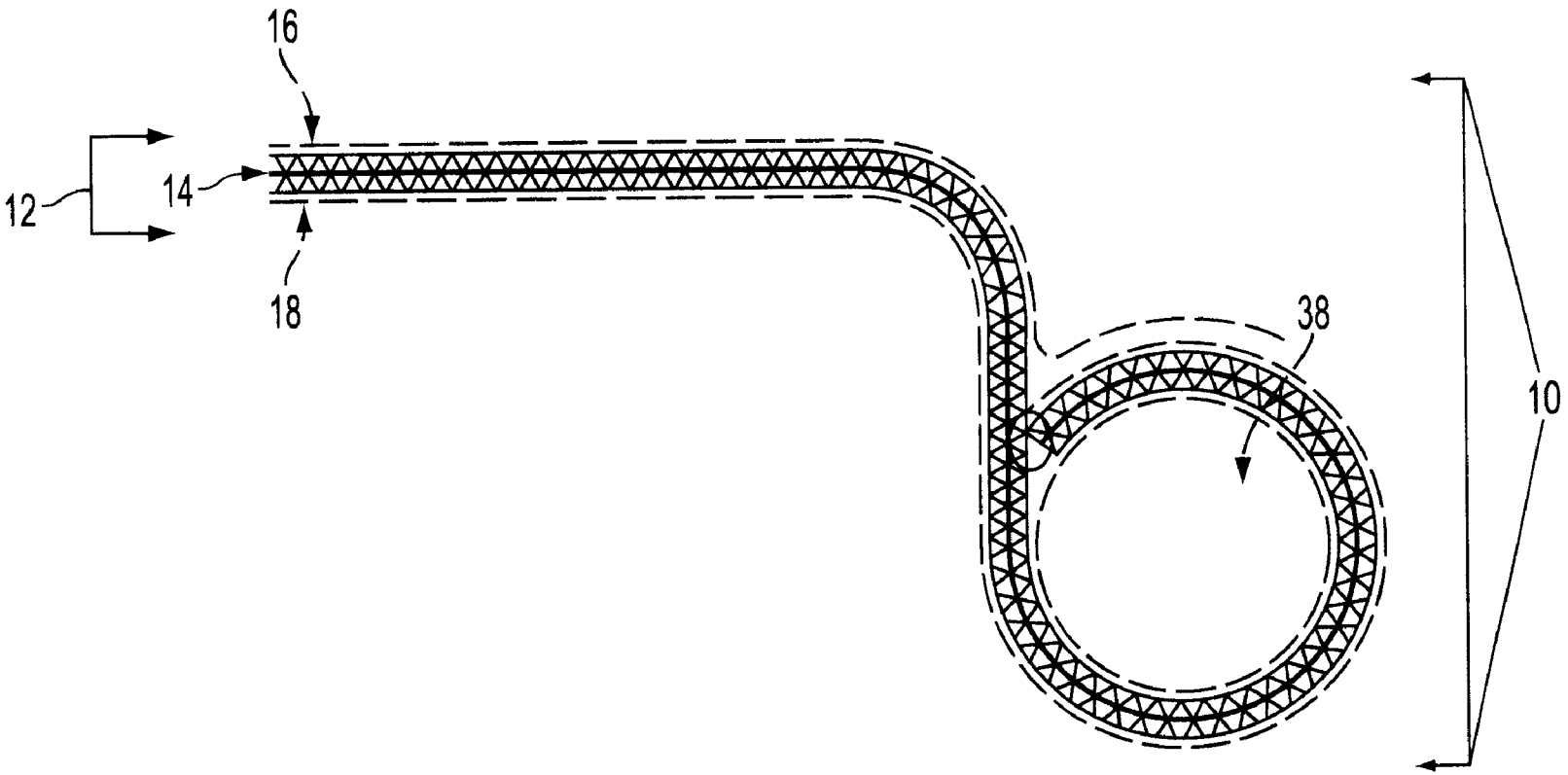
FIG. 2 is a cross-sectional view of an alternative embodiment of the present invention in operative combination with a roadway to provide roadway base or subbase drainage, wherein the drainage system is positioned between the roadway subgrade and portions of the roadway base aggregate.
Figure 5A:
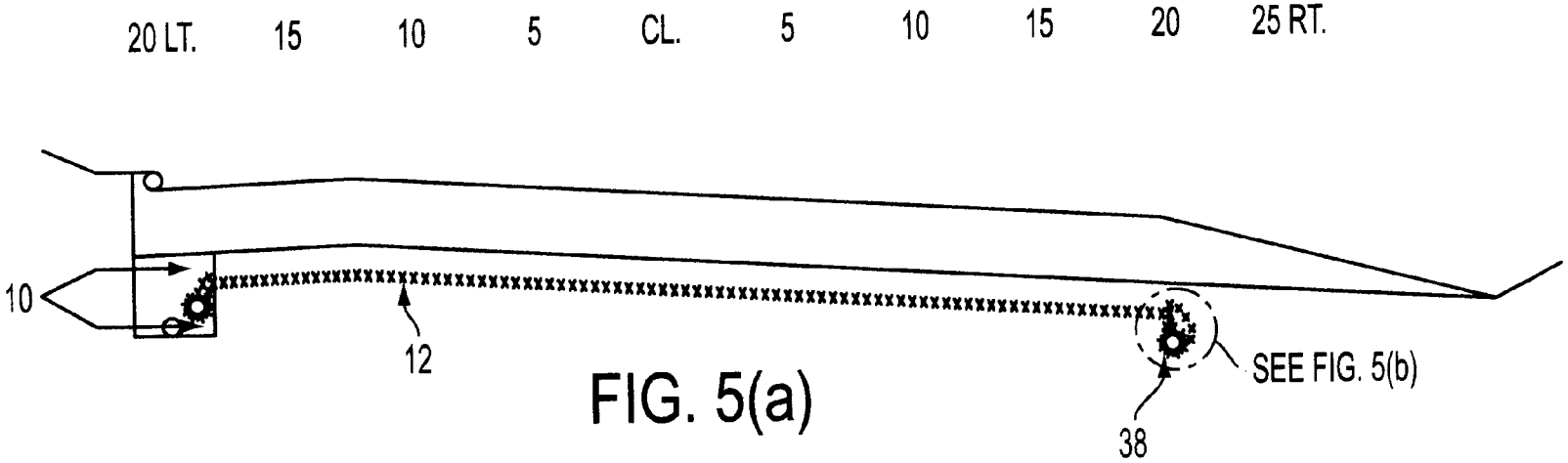
FIG. 5(*a*) is a cross-sectional view of a drainage system according to the invention and FIG. 5(*b*) shows details of portions of the unitary geocomposite connecting to a collection pipe installation where the system lies at the bottom of an aggregate layer.
Figure 5B:
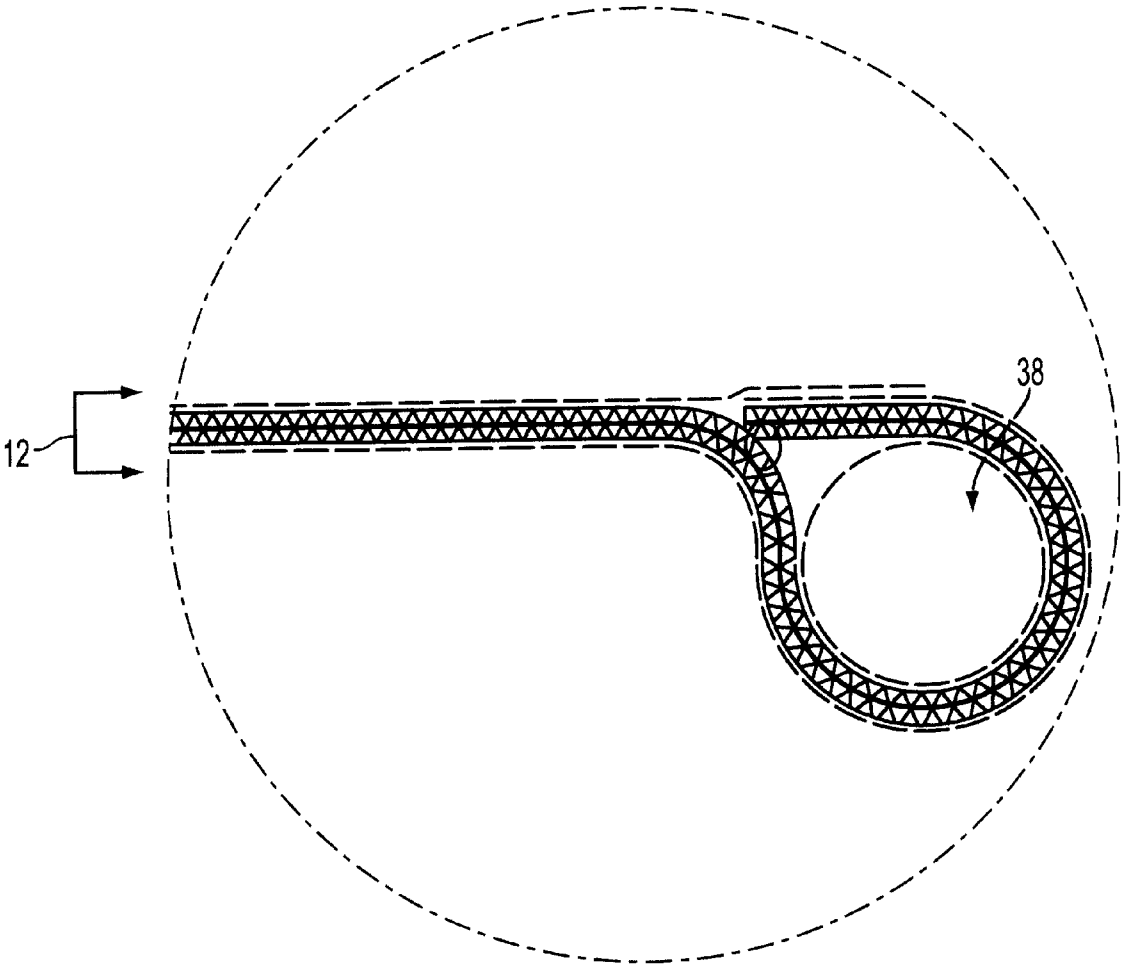

FIGS. 2 and 5(*b*) together show an alternative preferred embodiment of the present invention. In FIG. 2 a detailed cross-section of a portion of drainage system 10 is shown. Drainage system 10 generally comprises a void-maintaining geocomposite 12. Void-maintaining geocomposite 12 preferably includes a core 14 with a rigid upper and lower surface. Attached adjacent the upper surface of void-maintaining geocomposite 12 is upper surface geotextile 16 and firmly attached adjacent the lower surface of void-maintaining geocomposite 12 is lower surface geotextile 18. Advantageously, void-maintaining geocomposite 12 comprises a core element structured such that, under great compressive load, interconnecting voids are maintained therein. In the preferred embodiment shown, void-maintaining geocomposite 12 comprises a thick tri-planar polyethlene structure and geotextiles 16 and 18 comprise nonwoven needle punched, spun-bound or woven polymer-based textile or fabric-based structures adjacent to the respective upper and lower surfaces of geonet core 14. Geonet core element structures are generally known in geocomposite arts and therefore are not described in great detail herein. Commonly, a geonet comprises a thermoplastic polymer extrusion processed into a net style. Geonets can be adapted to use with the present invention by being further formed into structures which maintain void spaces under high compressive loads to thereby ensure a high transmissivity to fluids which in turn permits rapid drainage flow. Although a geonet core is preferred, other polymer-based geosynthetic core elements providing high transmissivity are also suitable to be used to form unitary geocomposites for subsurface drainage system 10.

Figure 3:
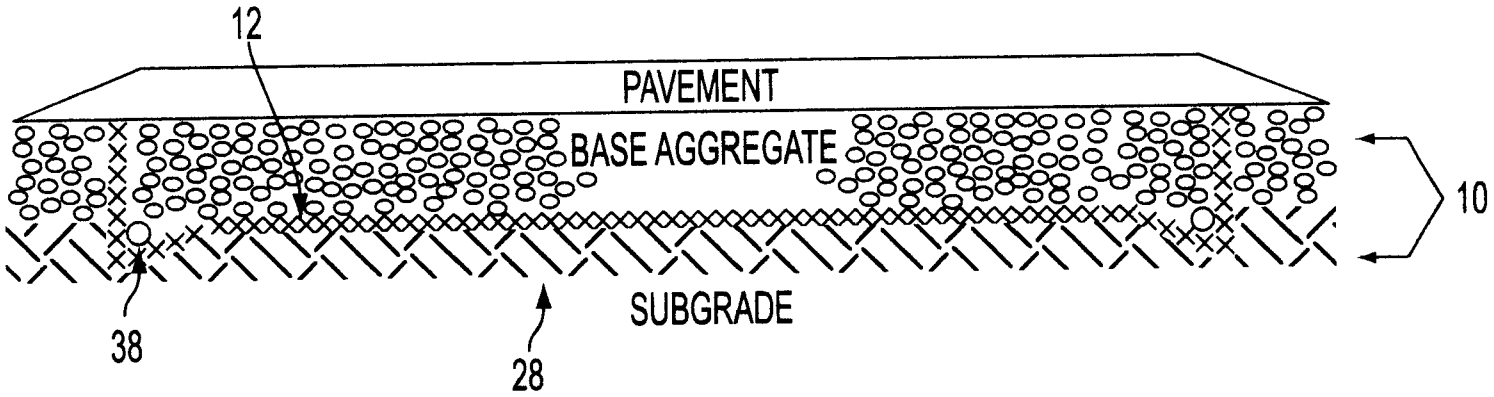
FIG. 3 is a cross-sectional view of another alternative embodiment of the present invention in which a unitary void-maintaining geocomposite-drain are shown in operative combination with a roadway having a surface of asphalt or concrete pavement.

FIG. 3 depict alternative preferred embodiments of the present invention. In FIG. 3, drainage system 10 lies directly underneath a PCC or asphalt layer 24. High-flow drainage is provided by drainage system 10 as it directs fluid such as rainwater either from the road surface to drain collection pipes 36. Also, drainage systems 10 may be positioned individually or in a plurality of sets in other sections of the subsurface structure depending upon design choice and specific drainage requirements. For example, buildings or parking lots in areas where upflow of water and other fluids is common may require a plurality of systems 10 at various levels and dispositions.

Figure 4A:
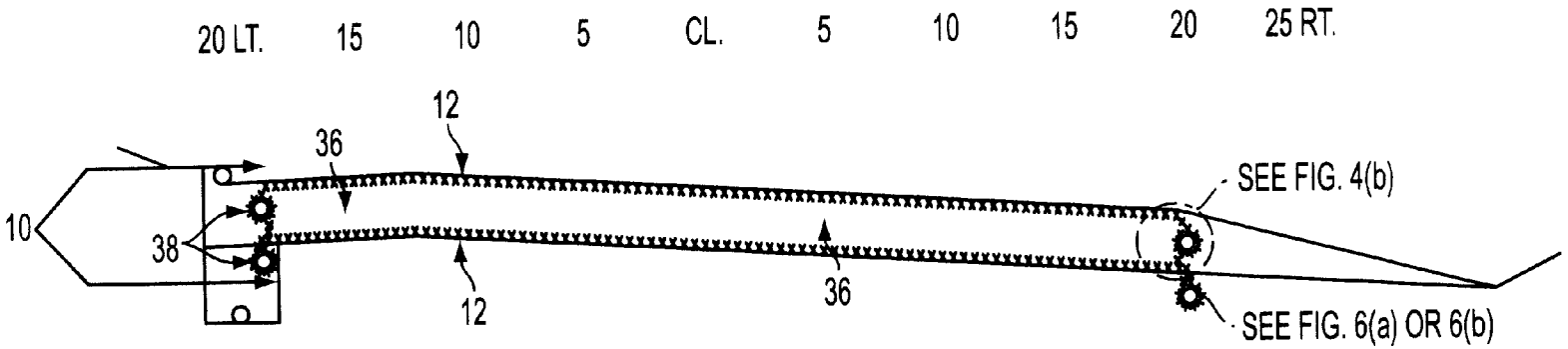
FIG. 4(*a*) is a cross-sectional view of a drainage system according to the invention, and FIG. 4(*b*) shows details of connecting portions of the unitary geocomposite to a collection pipe installation where the system lies below or over a subgrade.
Figure 4B:
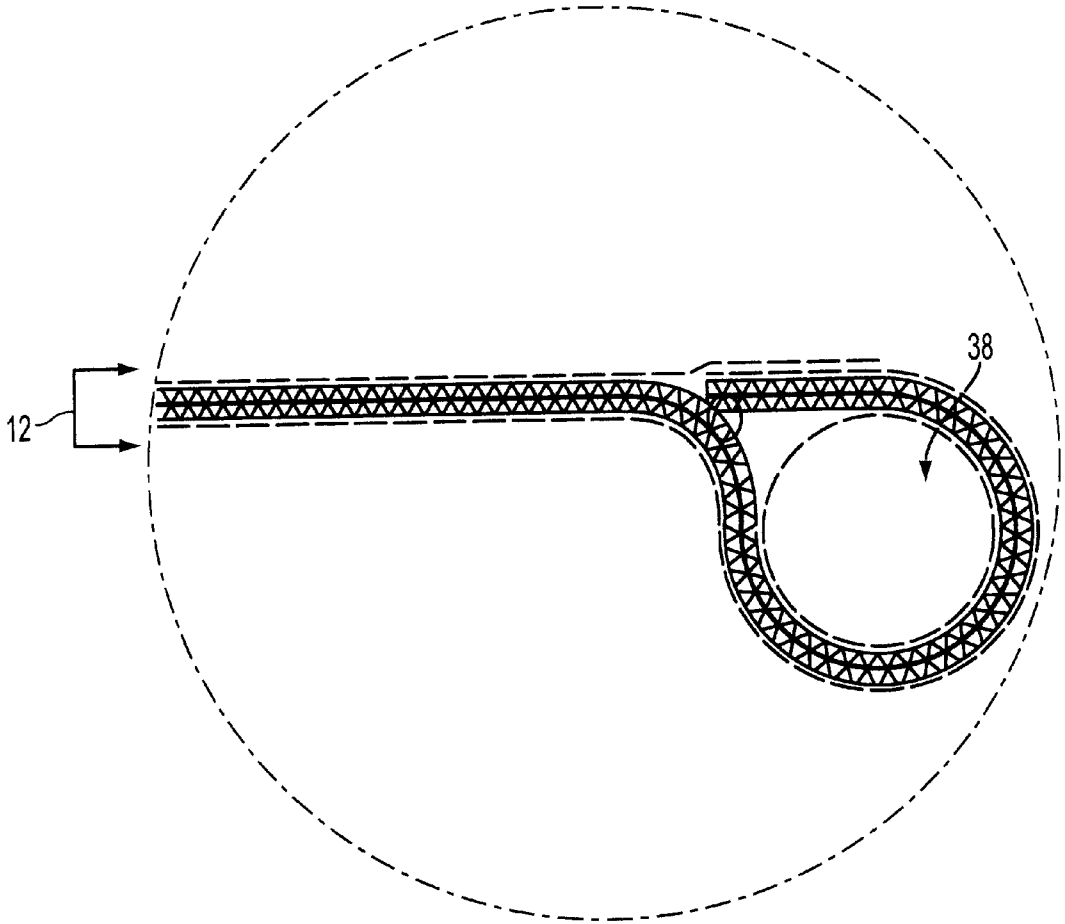

FIGS. 4 depict cross-sectional views of embodiments of drainage systems according to the invention and show details of connecting portions of the geocomposite to a collection pipe installation where the system lies below or over a subgrade, and where a system lies underneath an aggregate bed. FIG. 4 shows a detailed view of the attachment of void-maintaining geocomposite 12 to drainage collection pipe 38 for subsurface drainage system 10. FIG. 4 is directed to a preferred embodiment where drainage system 10 lies along the bottom of aggregate bed 32 while FIG. 4 shows graphically the relative placement of the geonet core 14 and geotextile layers 16 and 18. In some embodiments of the invention (not shown) a geonet core can be used without geotextile layers, that is, the UVMG is manufactured such that its outer surfaces are sufficiently occlusive to particular surrounding materials that no geotextile layers are needed. Advantageously, void-maintaining geocomposite 12 is wrapped around perforated pipe 38, wherein a portion of upper surface geotextile 18 is removed from the core element such as to ensure the free flow of fluid from void-maintaining geocomposite 12 to pipe 38. Preferably, the removed portion of geotextile 18 is overlapped with a portion of lower surface geotextile 14 to thereby prevent entry of clogging materials to the void spaces of system 10. The overlapping portions of geotextiles 18 and 16 are preferably connected to one another by welding, sewing, ties, adhesives or other means. Also, portions of the overlapping geonet core 14 are preferably secured adjacent perforated piping 38 by circumferential ties of plastic or polymeric braid (not shown).

Installation of drainage system 10 under a roadway, parking lot, building or retaining wall can be understood with reference to FIGS. 1–7. With reference to FIGS. 1–4, soil is removed below subgrade elevation to a depth appropriate to the particular project on a site-specific basis. Void-maintaining geocomposite 12, preferably from 8–12 mm thick, is placed across the entire roadway to create a capillary break. As depicted in FIGS. 1 and 3, void-maintaining geocomposite 12 is installed from rolls transported to the site and unrolled to cover the selected layer of the subsurface. In many embodiments, it is preferable to install the geocomposites such that the flow of fluid is directed in directions substantially perpendicular to the longitudinal axis of the roadway. Additionally, in some embodiments, void-maintaining geocomposite 12 may include edges running parallel to the longitudinal axis of the roadway wherein the edges serve as edge-drains connecting to drainage collection pipes.

Figure 6A:
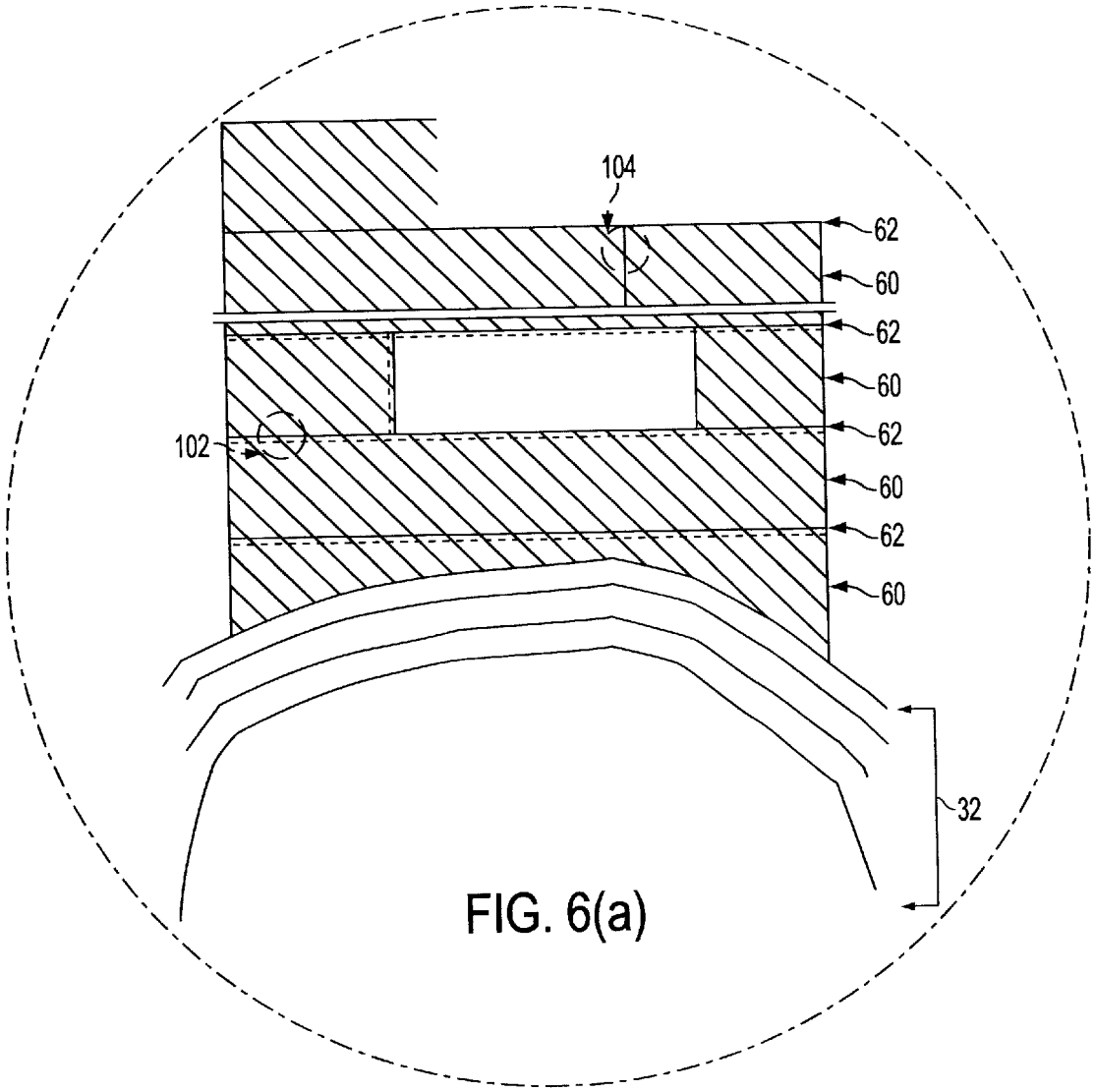
FIG. 6*a* is a cross-sectional view of adjacent unitary geocomposite rolls showing joint and tie intersections.
Figure 6B:
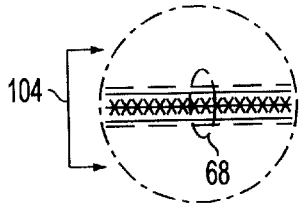
FIG. 6*b* depicts a detailed cross-sectional view of butt joint.
Figure 6C:
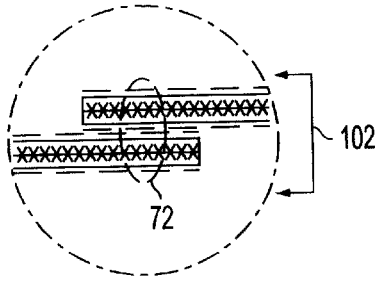
FIG. 6*c* is a detailed cross-sectional view of an overlap joint.

As shown in FIGS. 6*a*–6*c*, joints between roll sections can be overlapped to form overlap joints 102 or tied together to form butt joints 104. Preferably, overlapping occurs at least 3 inches along the void-maintaining geocomposites roll length and at least 3 inches along the void-maintaining geocomposite roll width while ties occur every one foot along the roll length and overlapping occurs in the direction that the excavation fill will be spread so that forces placed upon the void-maintaining geocomposites during installation do not resulted in unwanted shifting. Adjacent void-maintaining geocomposite rolls are preferably joined by tying together the geonet cores with plastic fasteners or polymeric braid spaced every 3 feet or so along the roll length and every one foot across the roll width or by an alternative design selection. Additional pieces of geotextile may be placed over the joint areas where two pieces of unitary void-maintaining geocomposite are joined.

Installation procedures are similar for other preferred embodiments of the present invention and are shown in, for example, FIGS. 2–6. As shown in FIG. 2, unitary void-maintaining geocomposite 12 rests over a subgrade. Preferably, the geocomposite lies at the bottom of the base of road subsurface structure and extends upward to wrap the base aggregate. In FIG. 3, void-maintaining geocomposite 12 lies directly underneath the PCC or asphalt layer to drain the pavement surface.

As shown in FIGS. 1 and 2, drainage collection pipe 38 is attached to void-maintaining geocomposites 12, and in some preferred embodiments, can be installed on preferably both sides of the roadway under road shoulder 26, for the entire length of drainage system 10 as it extends along the path of the roadway. The drainage pipe is freely fluid-transmissible, that is, porous, or preferably perforated, allowing high-flow drainage from void-maintaining geocomposites 12 to collection pipes 38, which are located at a depth below the level of void-maintaining geocomposites 12. Advantageously, outlets or valves for pipes 38 or geocomposites 12 may be provided for testing applications of drainage systems 10.

FIGS. 6(*b*) and 6(*c*) provide a cross-sectional view of adjacent void-maintaining geocomposite rolls 60 and their various manners of attachment for multiple preferred embodiments. Adjacent rolls comprising the upper geocomposite layer 62 lying over the top of aggregate 32 are tied together with plastic fasteners or polymeric braid. The tying of adjacent geonet cores is similarly done for the other gecomposite layers lying along the base of aggregate 32, and lying over and below the subgrade 36. Preferably for the upper geocomposite layer 62, joints 104 are formed between two connecting geocomposite core rolls by tying at the edge of the rolls using plastic fasteners or polymeric braid. FIG. 6*b* provides a cross-sectional view of butt joint 104 formed with the help of ties 68 for connecting two upper geocomposite rolls 60.

Alternatively, for connecting corresponding layers within the present systems, an overlap joint such as joint 72 is used to connect successive geocomposite rolls. FIG. 6*c* shows a detailed cross-sectional view of the overlapping performed for connecting geocomposite rolls 100 lying at the base of aggregate 32, and lying over and below subgrade 36. If necessary or desired for a particular application, portions of the high permittivity layer or layers may be removed from the core element in order to allow the maximum amount of effective interconnection between the core element and the drain pipes. Preferably, the overlapped portions of the geocomposite rolls are secured by heat bonding, adhesive, sewing, or some alternative design selection.

Figure 7:
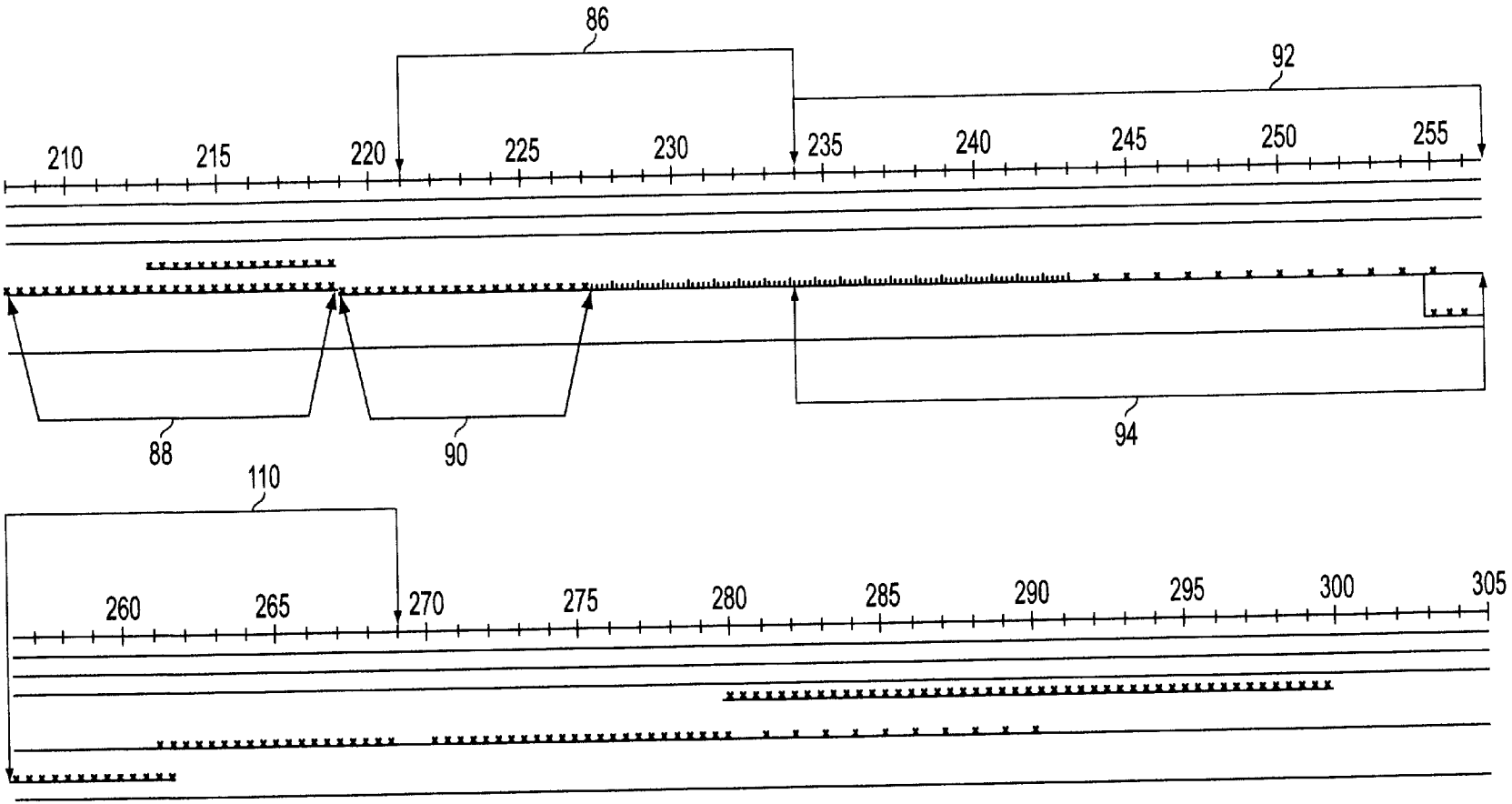
FIG. 7 is a cross-sectional view of unitary void-maintaining geocomposites combined with geotextile layers as part of a greater road subsurface geosynthetic drainage system.
Figure 8A:
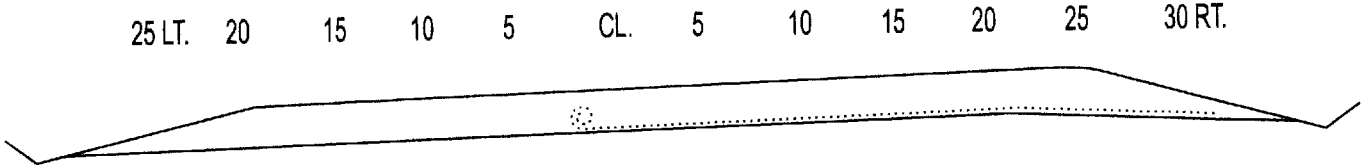
FIG. 8 is a cross-sectional view of a void-maintaining geocomposite as in FIG. 7 but without geotextile layers.
Figure 8B:
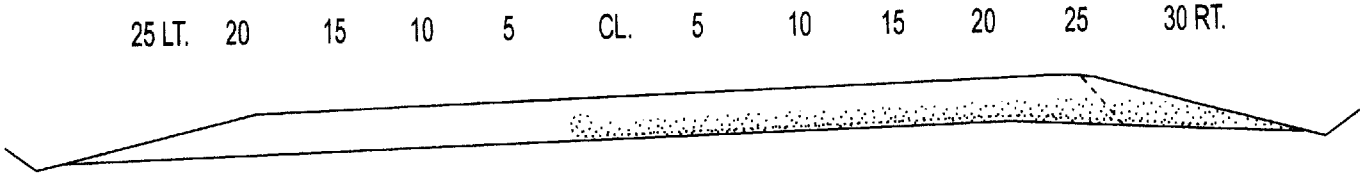
Figure 8C:
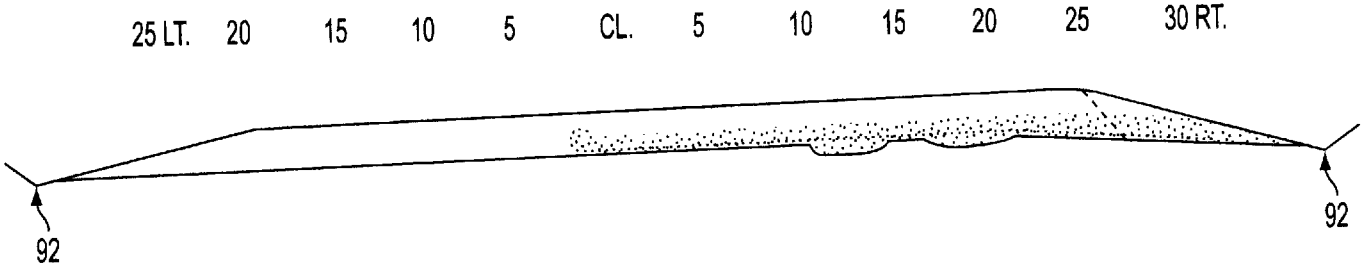
Figure 8D:
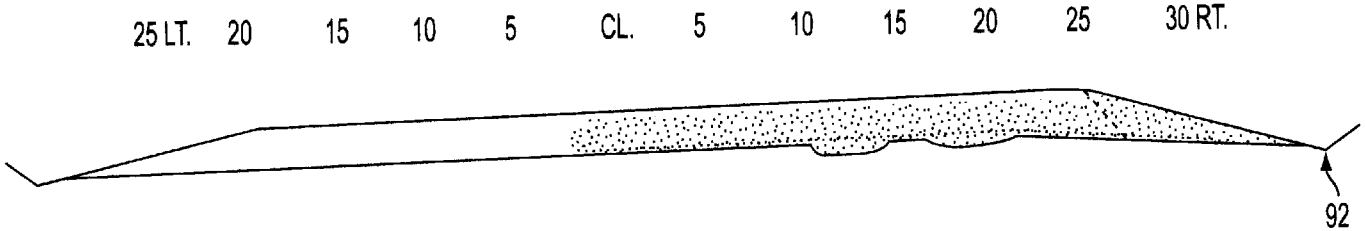

FIGS. 7 and 8 show drainage system 10 as part of a greater roadway subsurface system, geosynthetic system. In combination with the drainage section 110 running concurrently or successively with the other sections, a roadway subsurface system is created for efficient roadway performance and longer service life. FIG. 7 shows a drainage system 10 having upper and lower geotextile layers 90 joined to geonet core 114, while FIG. 8 shows a similar system where geonet 214, has no geotextile layers attached or adjacent thereto. Advantageously, major components of the present drainage systems can be designed and prepared at an off-site manufacturing facility to thereby decrease the probability of component errors inherent in on-site design and placement.

As one of skill in the art will appreciate, the present methods of the invention can include one or more of the elements described above in numerous permutations to arrive at high transmissivity and high permittivity drainage systems for roadways and other structures that are within the spirit and scope of the present.

What is claimed is:

1. A drainage system for draining fluids away from a roadway or other large structure, comprising:

A) a unitary void-maintaining geocomposite comprising i) a geocomposite core element having a plurality of interconnected voids, said core element being triplanar and having an upper surface and a lower surface, ii) at least one fluid-transmissible geotextile layer attached adjacent said upper surface, and iii) at least one fluid-transmissible geotextile layer attached adjacent said lower surface of said geocomposite core element, wherein said layers and said core element are constructed and arranged so that said unitary void-maintaining geocomposite maintains voids of desired dimension such that fluid from said roadway or other large structure can move freely through said geocomposite, and wherein said geocomposite is sloped downwardly from said roadway or other large structure, and B) drain means comprising perforated piping adjacent said void-maintaining geocomposite and communicating therewith such that said fluid can move from said void-maintaining geocomposite to said perforated piping, wherein said perforated piping is sloped downwardly from said void-maintaining geocomposite, wherein said void-maintaining geocomposite is constructed and arranged to form a wrapping adjacent to and around the circumference of at least a portion of said perforated piping such that a portion of one of said upper or lower fluid-transmissable geotextile layers is removed along the length of the wrapping so that said geocomposite core element contacts said perforated piping and said removed portion of said one of said upper or lower fluid-transmissable geotextile layers comprises overlapping portions and is connected to the other fluid-transmissible geotextile layer.

2. The drainage system of claim 1, wherein said perforated piping is connected to further drains means and wherein said further drain means is one or more selected from the group consisting of non-perforated pipes, drainage ditches, sumps, canals, streams and rivers.

3. The drainage system of claim 1, wherein one or both of said geotextile layers are formed separately from said core element and are attached to said core element by heat welding, laser welding, sonic welding, ties, sewing or one or more adhesives.

4. The drainage system of claim 1, wherein said geocomposite core element comprises a geonet.

5. The drainage system of claim 1, wherein said geocomposite core element comprises polyethlene.

6. The drainage system of claim 1, wherein one or both said geotextile layers are nonwoven and needle punched.

7. The drainage system of claim 1, wherein said overlapping portions of said fluid-transmissible geotextile layers are connected by welding.

8. The drainage system of claim 1, wherein said overlapping portions of said fluid-transmissible geotextile layers are connected by sewing.

9. The drainage system of claim 1, wherein said portions of said fluid-transmissible geotextile layers and said geocomposite core element of said void-maintaining geocomposite are held adjacent to said piping by circumferencial ties around said void-maintaining geocomposite.

10. The drainage system of claim 1, wherein said void-maintaining geocomposite is constructed and arranged to provide a capillary break between a top surface of said roadway and the earthen materials under said void-maintaining geocomposite.

11. The drainage system of claim 1, wherein said void-maintaining geocomposite is positioned intermittently below a top surface of said roadway.

12. The drainage system of claim 1, wherein said void-maintaining geocomposite is positioned continuously below a top surface of said roadway.

13. The drainage system of claim 1, wherein said void-maintaining geocomposite is positioned below a top surface of said roadway.

14. The drainage system of claim 1, wherein said void-maintaining geocomposite is positioned below a top surface of said roadway and below a subgrade.

15. The drainage system of claim 1, wherein said void-maintaining geocomposite is positioned below a top surface of said roadway and at least two feet below a subgrade.

16. The drainage system of claim 1, wherein said void-maintaining geocomposite is positioned below a top surface of said roadway and above an aggregate structure.

17. The drainage system of claim 1, wherein one or both of said geotextile layers are attached to said geocomposite core layer.

18. A method for constructing a drainage system for draining fluids away from a roadway or other large structure, comprising the steps of:

A) providing a unitary void-maintaining geocomposite comprising i) a geocomposite core element having a plurality of interconnected voids, said core element being triplanar and having an upper surface and a lower surface, ii) at least one fluid-transmissible geotextile layer attached adjacent said upper surface, and iii) at least one fluid-transmissible geotextile layer attached adjacent said lower surface of said geocomposite core element, wherein said layers and said core are element constructed and arranged so that said unitary void-maintaining geocomposite maintains voids of desired dimension such that fluid from said roadway or other large structure can move freely through said geocomposite, and wherein said geocomposite is sloped downwardly from said roadway or other large structure, and B) providing drain means comprising perforated piping adjacent said void-maintaining geocomposite and communicating therewith such that said fluid can move from said void-maintaining geocomposite to said perforated piping, wherein said perforated piping is sloped downwardly from said void-maintaining geocomposite, wherein said void-maintaining geocomposite is constructed and arranged to form a wrapping adjacent to and around the circumference of at least a portion of said perforated piping such that a portion of one of said upper or lower fluid-transmissible geotextile layers is removed along the length of the wrapping so that said geocomposite core element contacts said perforated piping and said removed portion of said one of said upper or lower fluid-transmissible geotextile layers comprises overlapping portions and is connected to the other fluid-transmissible geotextile layer.

* * * * *